US010789902B2

(12) United States Patent
Wang et al.

(10) Patent No.: US 10,789,902 B2
(45) **Date of Patent: *Sep. 29, 2020**

(54) ELECTRONIC DEVICE DISPLAY WITH CHARGE ACCUMULATION TRACKER

(71) Applicant: Apple Inc., Cupertino, CA (US)

(72) Inventors: Chaohao Wang, Sunnyvale, CA (US); Brijesh Tripathi, Los Altos, CA (US); Christopher Philip Alan Tann, San Jose, CA (US); David S. Zalatimo, San Jose, CA (US); Guy Cote, Aptos, CA (US); Hao Nan, Stanford, CA (US); Marc Albrecht, San Francisco, CA (US); Paolo Sacchetto, Cupertino, CA (US); Sandro H. Pintz, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 57 days.

This patent is subject to a terminal disclaimer.

(21) Appl. No.: 16/113,132

(22) Filed: Aug. 27, 2018

(65) Prior Publication Data

US 2018/0366078 A1 Dec. 20, 2018

Related U.S. Application Data

(63) Continuation of application No. 15/890,517, filed on Feb. 7, 2018, now Pat. No. 10,102,815, which is a (Continued)

(51) Int. Cl.
*G09G 3/36* (2006.01)

(52) U.S. Cl.
CPC ... *G09G 3/3614* (2013.01); *G09G 2320/0204* (2013.01); *G09G 2320/0247* (2013.01); (Continued)

(58) Field of Classification Search
None
See application file for complete search history.

(56) References Cited

U.S. PATENT DOCUMENTS 5,252,957 A 10/1993 Itakura
5,280,280 A * 1/1994 Hotto ..... G09G 3/3611 345/690

(Continued)

FOREIGN PATENT DOCUMENTS

JP H09-329527 12/1997
JP 2003-029689 1/2003

(Continued)

*Primary Examiner* — Dorothy Harris
(74) *Attorney, Agent, or Firm* — Treyz Law Group, P.C.; G. Victor Treyz; David K. Cole

(57) ABSTRACT

An electronic device may generate content that is to be displayed on a display. The display may have an array of liquid crystal display pixels for displaying image frames of the content. The image frames may be displayed with positive and negative polarities to help reduce charge accumulation effects. A charge accumulation tracker may analyze the image frames to determine when there is a risk of excess charge accumulation. The charge accumulation tracker may analyze information on gray levels, frame duration, and frame polarity. The charge accumulation tracker may compute a charge accumulation metric for entire image frames or may process subregions of each frame separately. When subregions are processed separately, each subregion may be individually monitored for a risk of excess charge accumulation.

19 Claims, 11 Drawing Sheets

Related U.S. Application Data continuation of application No. 14/722,620, filed on May 27, 2015, now Pat. No. 9,922,608.

(52) U.S. Cl.
CPC ..... *G09G 2320/0257* (2013.01); *G09G 2320/046* (2013.01); *G09G 2340/0435* (2013.01); *G09G 2360/16* (2013.01)

(56) References Cited

U.S. PATENT DOCUMENTS

| | | | | |
|---|---|---|---|---|
| 6,262,703 | B1 * | 7/2001 | Perner | G09G 3/3648 345/90 |
| 6,930,692 | B1 * | 8/2005 | Coker | G09G 3/2018 345/100 |
| 8,487,919 | B2 | 7/2013 | Kobayashi | |
| 9,030,426 | B2 | 5/2015 | Edwards et al. | |
| 9,495,926 | B2 | 11/2016 | Tripathi et al. | |
| 9,922,608 | B2 * | 3/2018 | Wang | G09G 3/3614 |
| 10,102,815 | B2 * | 10/2018 | Wang | G09G 3/3614 |
| 10,410,587 | B2 * | 9/2019 | Garbacea | G09G 3/3291 |
| 2002/0027541 | A1 * | 3/2002 | Cairns | G09G 3/3611 345/87 |
| 2002/0093473 | A1 | 7/2002 | Tanaka et al. | |
| 2002/0180673 | A1 | 12/2002 | Tsuda et al. | |
| 2004/0108988 | A1 * | 6/2004 | Choi | G09G 3/3614 345/96 |
| 2004/0165064 | A1 * | 8/2004 | Weitbruch | G09G 3/22 348/173 |
| 2006/0022932 | A1 | 2/2006 | Sagawa et al. | |
| 2009/0079713 | A1 * | 3/2009 | Nagashima | G09G 3/3677 345/204 |
| 2009/0251451 | A1 | 10/2009 | Cha et al. | |
| 2011/0037760 | A1 | 2/2011 | Kim et al. | |
| 2011/0285759 | A1 * | 11/2011 | Sakai | G09G 3/3648 345/690 |
| 2011/0292099 | A1 | 12/2011 | Kim et al. | |
| 2012/0062610 | A1 * | 3/2012 | Tai | G09G 3/3614 345/690 |
| 2012/0206500 | A1 | 8/2012 | Koprowski et al. | |
| 2013/0162697 | A1 | 6/2013 | Kobayashi et al. | |
| 2013/0249880 | A1 | 9/2013 | Chen et al. | |
| 2014/0085348 | A1 | 3/2014 | Tsuda et al. | |
| 2014/0184580 | A1 | 7/2014 | Cho | |
| 2014/0333516 | A1 | 11/2014 | Park et al. | |
| 2014/0368484 | A1 | 12/2014 | Tanaka et al. | |
| 2015/0002381 | A1 * | 1/2015 | Fujioka | G09G 3/3614 345/87 |
| 2015/0194111 | A1 * | 7/2015 | Slavenburg | G09G 3/3618 345/209 |
| 2015/0243233 | A1 | 8/2015 | Bloks et al. | |
| 2015/0243234 | A1 * | 8/2015 | Bloks | G09G 3/3614 345/96 |
| 2016/0267857 | A1 * | 9/2016 | Watanabe | G09G 3/3614 |
| 2016/0343318 | A1 | 11/2016 | Wang et al. | |

FOREIGN PATENT DOCUMENTS

| | | |
|---|---|---|
| JP | 2007-225861 | 9/2007 |
| WO | 2015060312 | 4/2015 |

* cited by examiner

B1 = 2 C1 = 2
B2 = 1 C2 = 1
B3 = 10 C3 = 10
B4 = 1 C4 = 1

B1 = -3 C1 = -1
B2 = -1 C2 = 0
B3 = -11 C3 = -1
B4 = -1 C4 = 0

B1 = 4 C1 = 3
B2 = 1 C2 = 1
B3 = 10 C3 = 9
B4 = 1 C4 = 1

B1 = -1 C1 = 2
B2 = -2 C2 = -1
B3 = -2 C3 = 7
B4 = -9 C4 = -8

B1 = 2 C1 = 4
B2 = 1 C2 = 0
B3 = 10 C3 = 17 > TH
B4 = 1 C4 = -7

ELECTRONIC DEVICE DISPLAY WITH CHARGE ACCUMULATION TRACKER

This application is a continuation of U.S. patent application Ser. No. 15/890,517, filed Feb. 7, 2018, which is a continuation of U.S. patent application Ser. No. 14/722,620, filed May 27, 2015, now U.S. Pat. No. 9,922,608, which are hereby incorporated by reference herein in their entireties. This application claims the benefit of and claims priority to U.S. patent application Ser. No. 15/890,517, filed Feb. 7, 2018, and U.S. patent application Ser. No. 14/722,620, filed May 27, 2015, now U.S. Pat. No. 9,922,608.

BACKGROUND

This relates generally to electronic devices, and more particularly, to electronic devices with displays.

Electronic devices often include displays. For example, cellular telephones and portable computers often include displays for presenting information to a user.

Liquid crystal displays contain a layer of liquid crystal material. Pixels in a liquid crystal display contain thin-film transistors and pixel electrodes for applying electric fields to the liquid crystal material. The strength of the electric field in a pixel controls the polarization state of the liquid crystal material and thereby adjusts the brightness of the pixel.

There is a potential for ions in a liquid crystal display to move in response to applied electric fields. This can lead to charge accumulation on the pixels. Another cause of charge accumulation is dielectric polarization. Charge accumulation effects can produce visible artifacts on a display such as undesired flickering.

To minimize charge accumulation in a liquid crystal display, the polarity of the electric field applied to the pixels may be periodically reversed. For example, alternating positive polarity and negative polarity frames of image data may be displayed on the pixels of a liquid crystal display to prevent excess positive or negative charge accumulation. Although periodic polarity reversal can help reduce charge accumulation, charge accumulation issues may still arise in liquid crystal displays. Charge accumulation may arise, for example, in situations in which a software application or other content generator creates negative and positive frames of image data with unbalanced gray levels. The risk of undesired charge accumulation may be exacerbated in displays with a variable refresh rate.

It would therefore be desirable to be able to provide displays with enhanced charge accumulation mitigation capabilities.

SUMMARY

An electronic device may generate content that is to be displayed on a display. The display may be a liquid crystal display have an array of liquid crystal display pixels. Display driver circuitry in the display may display image frames on the array of pixels. The image frames may be displayed with positive and negative polarities to help reduce charge accumulation effects.

A charge accumulation tracker may analyze the image frames to determine when there is a risk of excess charge accumulation. The charge accumulation tracker may use information on gray levels in the displayed image frames, frame duration information, and frame polarity information as inputs. The charge accumulation tracker may compute a charge accumulation metric based on the gray levels, frame duration, and frame polarity. Weights that are retrieved from a look-up table or that are represented using a mathematical expression may be applied to the inputs of the charge accumulation tracker. For example, the charge accumulation tracker may apply weights to the inputs that vary as a function of gray level, image frame duration, and polarity.

The charge accumulation tracker may compute the charge accumulation metric for entire image frames or may process subregions of each frame separately. When subregions are processed separately, each subregion may be individually monitored for a risk of excess charge accumulation by comparing a charge accumulation metric for that subregion to a threshold.

DETAILED DESCRIPTION

Electronic devices may include displays. The displays may be used to display images to a user. Illustrative electronic devices that may be provided with displays are shown in FIGS. 1, 2, 3, and 4.

Figure 1:
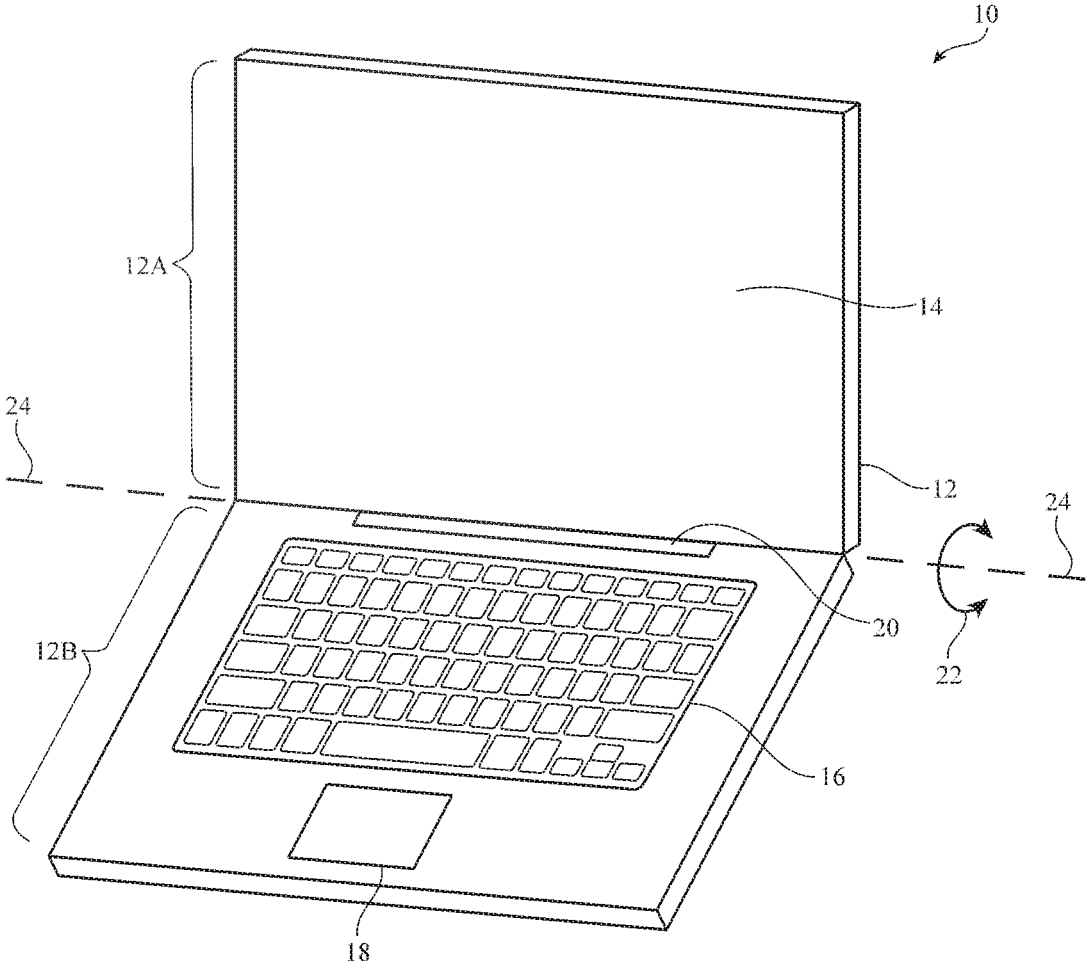
FIG. 1 is a perspective view of an illustrative electronic device such as a laptop computer with a display in accordance with an embodiment.

FIG. 1 shows how electronic device 10 may have the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes referred to as a display housing or lid, may be placed in a closed position by rotating upper housing 12A towards lower housing 12B about rotational axis 24.

Figure 2:
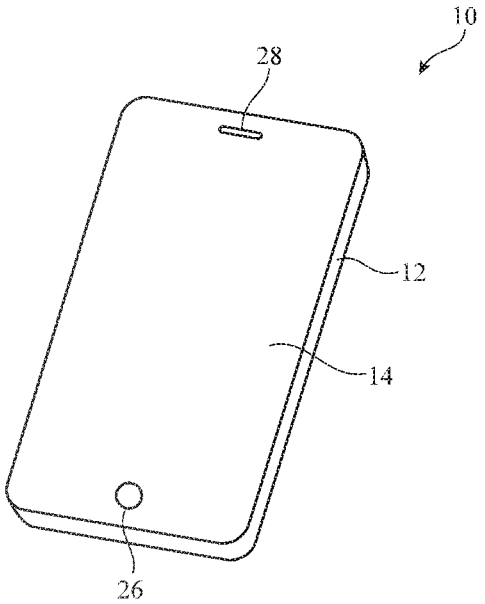
FIG. 2 is a perspective view of an illustrative electronic device such as a handheld electronic device with a display in accordance with an embodiment.

FIG. 2 shows how electronic device 10 may be a handheld device such as a cellular telephone, music player, gaming device, navigation unit, watch, or other compact device. In this type of configuration for device 10, housing 12 may have opposing front and rear surfaces. Display 14 may be mounted on a front face of housing 12. Display 14 may, if desired, have openings for components such as button 26. Openings may also be formed in display 14 to accommodate a speaker port (see, e.g., speaker port 28 of FIG. 2). In compact devices such as wrist-watch devices, port 28 and/or button 26 may be omitted and device 10 may be provided with a strap or lanyard.

Figure 3:
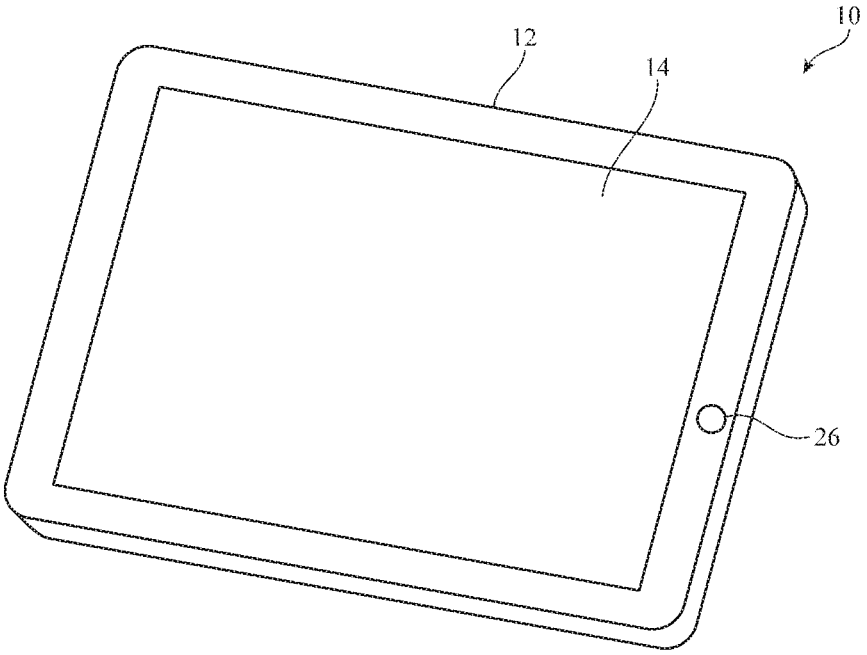
FIG. 3 is a perspective view of an illustrative electronic device such as a tablet computer with a display in accordance with an embodiment.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have an opening to accommodate button 26 (as an example).

Figure 4:
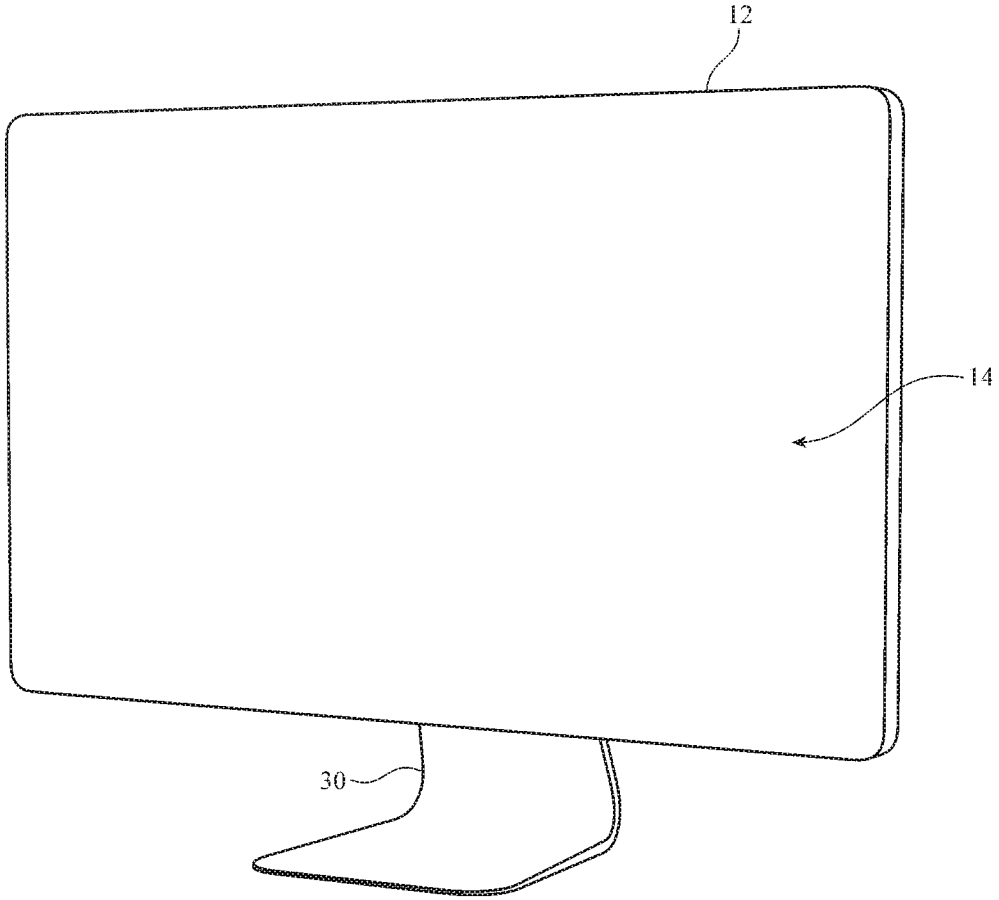
FIG. 4 is a perspective view of an illustrative electronic device such as a computer or other device with display structures in accordance with an embodiment.

FIG. 4 shows how electronic device 10 may be a display such as a computer monitor, a computer that has been integrated into a computer display, or other device with a built-in display. With this type of arrangement, housing 12 for device 10 may be mounted on a support structure such as stand 30 or stand 30 may be omitted (e.g., to mount device 10 on a wall). Display 14 may be mounted on a front face of housing 12.

The illustrative configurations for device 10 that are shown in FIGS. 1, 2, 3, and 4 are merely illustrative. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Display 14 for device 10 may include pixels formed from liquid crystal display (LCD) components. A display cover layer may cover the surface of display 14 or a display layer such as a color filter layer or other portion of a display may be used as the outermost (or nearly outermost) layer in display 14. The outermost display layer may be formed from a transparent glass sheet, a clear plastic layer, or other transparent member.

Figure 5:
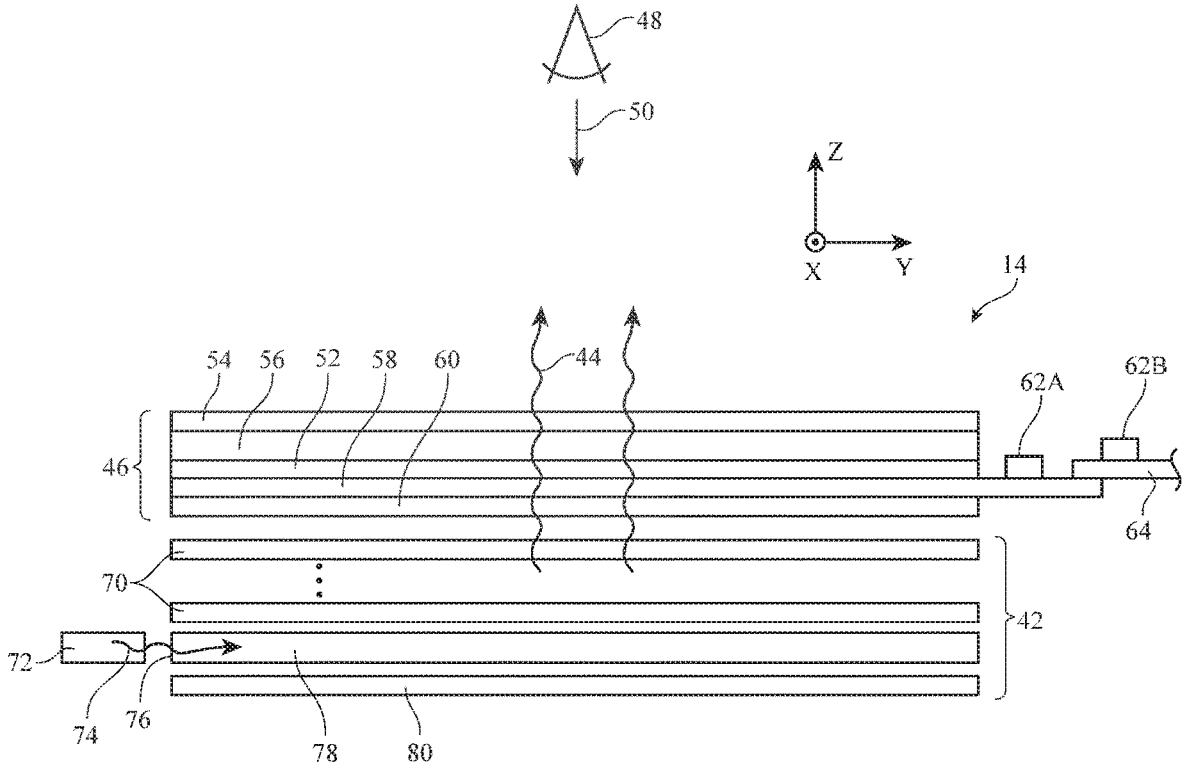
FIG. 5 is a cross-sectional side view of an illustrative display in accordance with an embodiment.

A cross-sectional side view of an illustrative configuration for display 14 of device 10 (e.g., for display 14 of the devices of FIG. 1, FIG. 2, FIG. 3, FIG. 4 or other suitable electronic devices) is shown in FIG. 5. As shown in FIG. 5, display 14 may include backlight structures such as backlight unit 42 for producing backlight 44. During operation, backlight 44 travels outwards (vertically upwards in dimension Z in the orientation of FIG. 5) and passes through display pixel structures in display layers 46. This illuminates any images that are being produced by the display pixels for viewing by a user. For example, backlight 44 may illuminate images on display layers 46 that are being viewed by viewer 48 in direction 50.

Display layers 46 may be mounted in chassis structures such as a plastic chassis structure and/or a metal chassis structure to form a display module for mounting in housing 12 or display layers 46 may be mounted directly in housing 12 (e.g., by stacking display layers 46 into a recessed portion in housing 12). Display layers 46 may form a liquid crystal display or may be used in forming displays of other types.

Display layers 46 may include a liquid crystal layer such a liquid crystal layer 52. Liquid crystal layer 52 may be sandwiched between display layers such as display layers 58 and 56. Layers 56 and 58 may be interposed between lower polarizer layer 60 and upper polarizer layer 54.

Layers 58 and 56 may be formed from transparent substrate layers such as clear layers of glass or plastic. Layers 58 and 56 may be layers such as a thin-film transistor layer and/or a color filter layer. Conductive traces, color filter elements, transistors, and other circuits and structures may be formed on the substrates of layers 58 and 56 (e.g., to form a thin-film transistor layer and/or a color filter layer). Touch sensor electrodes may also be incorporated into layers such as layers 58 and 56 and/or touch sensor electrodes may be formed on other substrates.

With one illustrative configuration, layer 58 may be a thin-film transistor layer that includes an array of pixel circuits based on thin-film transistors and associated electrodes (pixel electrodes) for applying electric fields to liquid crystal layer 52 and thereby displaying images on display 14. Layer 56 may be a color filter layer that includes an array of color filter elements for providing display 14 with the ability to display color images. If desired, layer 58 may be a color filter layer and layer 56 may be a thin-film transistor layer. Configurations in which color filter elements are combined with thin-film transistor structures on a common substrate layer in the upper or lower portion of display 14 may also be used.

During operation of display 14 in device 10, control circuitry (e.g., one or more integrated circuits on a printed circuit) may be used to generate information to be displayed on display 14 (e.g., display data). The information to be displayed may be conveyed to a display driver integrated circuit such as circuit 62A or 62B using a signal path such as a signal path formed from conductive metal traces in a rigid or flexible printed circuit such as printed circuit 64 (as an example).

Backlight structures 42 may include a light guide plate such as light guide plate 78. Light guide plate 78 may be formed from a transparent material such as clear glass or plastic. During operation of backlight structures 42, a light source such as light source 72 may generate light 74. Light source 72 may be, for example, an array of light-emitting diodes.

Light 74 from light source 72 may be coupled into edge surface 76 of light guide plate 78 and may be distributed in dimensions X and Y throughout light guide plate 78 due to the principal of total internal reflection. Light guide plate 78 may include light-scattering features such as pits or bumps. The light-scattering features may be located on an upper surface and/or on an opposing lower surface of light guide plate 78. Light source 72 may be located at the left of light guide plate 78 as shown in FIG. 5 or may be located along the right edge of plate 78 and/or other edges of plate 78.

Light 74 that scatters upwards in direction Z from light guide plate 78 may serve as backlight 44 for display 14. Light 74 that scatters downwards may be reflected back in the upwards direction by reflector 80. Reflector 80 may be formed from a reflective material such as a layer of plastic covered with a dielectric mirror thin-film coating.

To enhance backlight performance for backlight structures 42, backlight structures 42 may include optical films 70. Optical films 70 may include diffuser layers for helping to homogenize backlight 44 and thereby reduce hotspots, compensation films for enhancing off-axis viewing, and brightness enhancement films (also sometimes referred to as turning films) for collimating backlight 44. Optical films 70 may overlap the other structures in backlight unit 42 such as light guide plate 78 and reflector 80. For example, if light guide plate 78 has a rectangular footprint in the X-Y plane of FIG. 5, optical films 70 and reflector 80 may have a matching rectangular footprint. If desired, films such as compensation films may be incorporated into other layers of display 14 (e.g., polarizer layers).

Figure 6:
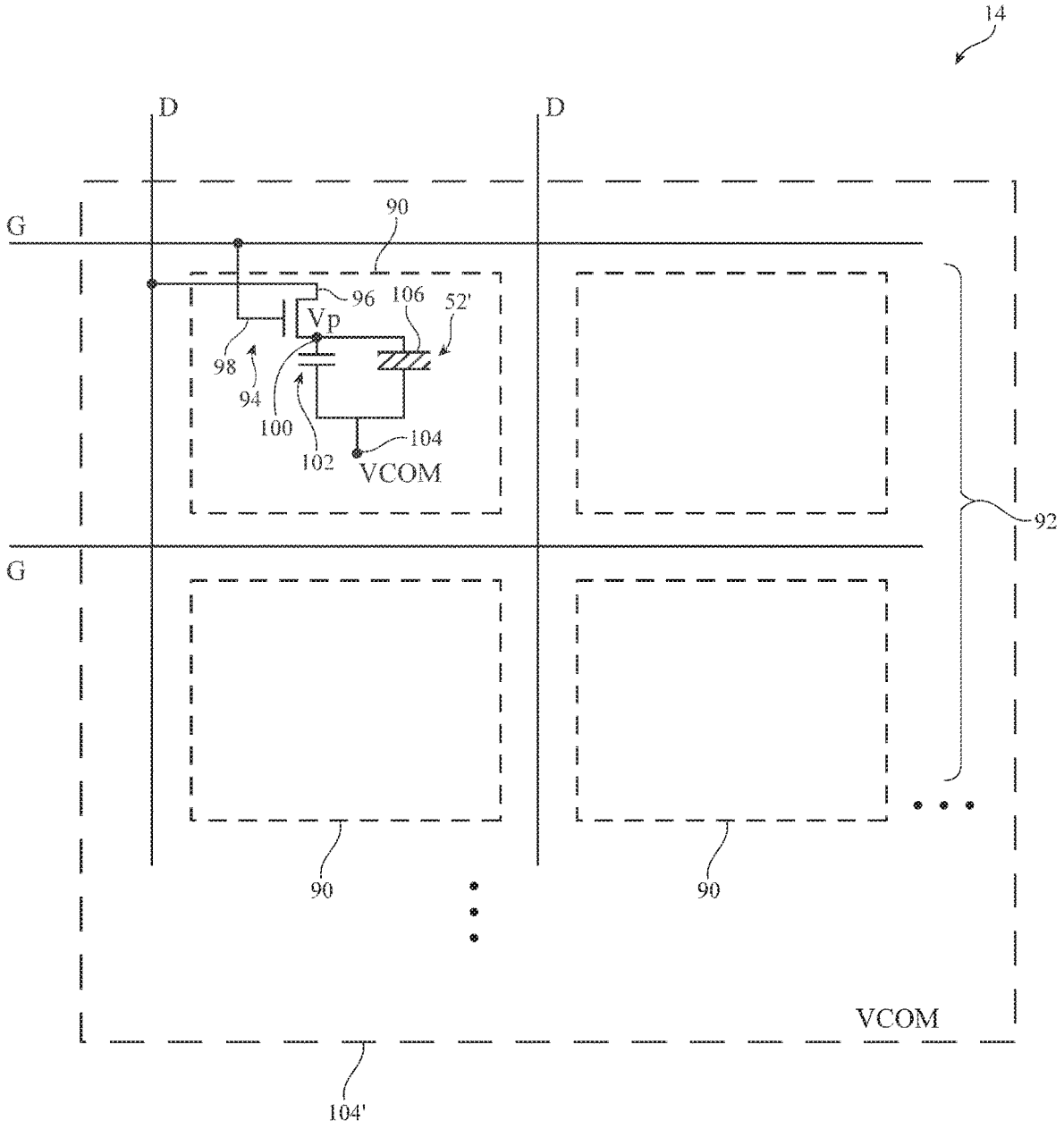
FIG. 6 is a top view of a portion of an array of pixels in a display in accordance with an embodiment.

As shown in FIG. 6, display 14 may include an array of pixels 90 such as pixel array 92. Pixel array 92 may be controlled using control signals produced by display driver circuitry. Display driver circuitry may be implemented using one or more integrated circuits (ICs) and/or thin-film transistors or other circuitry.

During operation of device 10, control circuitry in device 10 such as memory circuits, microprocessors, and other storage and processing circuitry may provide data to the display driver circuitry. The display driver circuitry may convert the data into signals for controlling pixels 90 of pixel array 92.

Pixel array 92 may contain rows and columns of pixels 90. The circuitry of pixel array 92 (i.e., the rows and columns of pixel circuits for pixels 90) may be controlled using signals such as data line signals on data lines D and gate line signals on gate lines G. Data lines D and gate lines G are orthogonal. For example, data lines D may extend vertically and gate lines G may extend horizontally (i.e., perpendicular to data lines D).

Pixels 90 in pixel array 92 may contain thin-film transistor circuitry (e.g., polysilicon transistor circuitry, amorphous silicon transistor circuitry, semiconducting-oxide transistor circuitry such as InGaZnO transistor circuitry, other silicon or semiconducting-oxide transistor circuitry, etc.) and associated structures for producing electric fields across liquid crystal layer 52 in display 14. Each liquid crystal display pixel may have one or more thin-film transistors. For example, each pixel may have a respective thin-film transistor such as thin-film transistor 94 to control the application of electric fields to a respective pixel-sized portion 52' of liquid crystal layer 52.

The thin-film transistor structures that are used in forming pixels 90 may be located on a thin-film transistor substrate such as a layer of glass. The thin-film transistor substrate and the structures of display pixels 90 that are formed on the surface of the thin-film transistor substrate collectively form thin-film transistor layer 58 (FIG. 5).

Gate driver circuitry may be used to generate gate signals on gate lines G. The gate driver circuitry may be formed from thin-film transistors on the thin-film transistor layer or may be implemented in separate integrated circuits. The data line signals on data lines D in pixel array 92 carry analog image data (e.g., voltages with magnitudes representing pixel brightness levels). During the process of displaying images on display 14, a display driver integrated circuit or other circuitry may receive digital data from control circuitry and may produce corresponding analog data signals. The analog data signals may be demultiplexed and provided to data lines D.

The data line signals on data lines D are distributed to the columns of display pixels 90 in pixel array 92. Gate line signals on gate lines G are provided to the rows of pixels 90 in pixel array 92 by associated gate driver circuitry.

The circuitry of display 14 may be formed from conductive structures (e.g., metal lines and/or structures formed from transparent conductive materials such as indium tin oxide) and may include transistors such as transistor 94 of FIG. 6 that are fabricated on the thin-film transistor substrate layer of display 14. The thin-film transistors may be, for example, silicon thin-film transistors or semiconducting-oxide thin-film transistors.

As shown in FIG. 6, pixels such as pixel 90 may be located at the intersection of each gate line G and data line D in array 92. A data signal on each data line D may be supplied to terminal 96 from one of data lines D. Thin-film transistor 94 (e.g., a thin-film polysilicon transistor, an amorphous silicon transistor, or an oxide transistor such as a transistor formed from a semiconducting oxide such as indium gallium zinc oxide) may have a gate terminal such as gate 98 that receives gate line control signals on gate line G. When a gate line control signal is asserted, transistor 94 will be turned on and the data signal at terminal 96 will be passed to node 100 as pixel voltage Vp. Data for display 14 may be displayed in frames. Following assertion of the gate line signal in each row to pass data signals to the pixels of that row, the gate line signal may be deasserted. In a subsequent display frame, the gate line signal for each row may again be asserted to turn on transistor 94 and capture new values of Vp.

Pixel 90 may have a signal storage element such as capacitor 102 or other charge storage elements. Storage capacitor 102 may be used to help store signal Vp in pixel 90 between frames (i.e., in the period of time between the assertion of successive gate signals).

Display 14 may have a common electrode coupled to node 104. The common electrode (which is sometimes referred to as the common voltage electrode, Vcom electrode, or Vcom terminal) may be used to distribute a common electrode voltage such as common electrode voltage Vcom to nodes such as node 104 in each pixel 90 of array 92. As shown by illustrative electrode pattern 104' of FIG. 6, Vcom electrode 104 may be implemented using a blanket film of a transparent conductive material such as indium tin oxide, indium zinc oxide, other transparent conductive oxide material, and/or a layer of metal that is sufficiently thin to be transparent (e.g., electrode 104 may be formed from a layer of indium tin oxide or other transparent conductive layer that covers all of pixels 90 in array 92).

In each pixel 90, capacitor 102 may be coupled between nodes 100 and 104. A parallel capacitance arises across nodes 100 and 104 due to electrode structures in pixel 90 that are used in controlling the electric field through the liquid crystal material of the pixel (liquid crystal material 52'). As shown in FIG. 6, electrode structures 106 (e.g., a display pixel electrode with multiple fingers or other display pixel electrode for applying electric fields to liquid crystal material 52') may be coupled to node 100 (or a multi-finger display pixel electrode may be formed at node 104). During operation, electrode structures 106 may be used to apply a controlled electric field (i.e., a field having a magnitude proportional to Vp−Vcom) across pixel-sized liquid crystal material 52' in pixel 90. Due to the presence of storage capacitor 102 and the parallel capacitances formed by the pixel structures of pixel 90, the value of Vp (and therefore the associated electric field across liquid crystal material 52') may be maintained across nodes 106 and 104 for the duration of the frame.

The electric field that is produced across liquid crystal material 52' causes a change in the orientations of the liquid crystals in liquid crystal material 52'. This changes the polarization of light passing through liquid crystal material 52'. The change in polarization may, in conjunction with polarizers 60 and 54 of FIG. 5, be used in controlling the amount of light 44 that is transmitted through each pixel 90 in array 92 of display 14 so that image frames may be displayed on display 14.

Charge accumulation issues may arise from repeated application of electric fields across liquid crystal material 52' using applied voltages Vp−Vcom of a single polarity. Accordingly, the polarity of the electric field may be periodically alternated. As an example, in odd frames a positive voltage Vp−Vcom may be applied across material 52', whereas in even frames a negative voltage Vp−Vcom may be applied across material 52'. To ensure that charge accumulation effects are not present (even when periodically reversing the polarity of the image frames), device 10 can incorporate charge accumulation monitoring functionality. For example, a charge accumulation tracker can be implemented in device 10 that monitors display 14 for excessive charge accumulation conditions. If suitable criteria are satisfied (i.e., if a calculated charge accumulation level exceeds a predetermined charge accumulation threshold for all or part of display 14), appropriate remedial actions may be taken.

Charge accumulation effects arise when non-black content is displayed. Black content and other content with low gray levels does not involve application of large electric fields to display 14 and therefore does not give rise to significant charge accumulation. Content with large gray levels (e.g., white content), however, is associated with large electric fields across layer 52 and therefore has the potential to lead to charge accumulation. In addition to being dependent on the gray level of displayed image frames, charge accumulation effects are also dependent on the amount of time that white content (high gray level content) is displayed for each polarity.

Charge accumulation can become excessive when the images that are displayed on display 14 do not contain content that is evenly divided between positive and negative frames. For example, excessive charge accumulation conditions may arise when more white content is displayed during positive frames than during negative frames. The likelihood that excessive charge accumulation conditions will arise may be exacerbated in displays that implement variable refresh rate schemes. With a variable refresh rate scheme, display 14 is sometimes operated with a relatively high frame rate and is sometimes operated with a relatively low frame rate. The high frame rate may be used to display rapidly moving content. The low frame rate may be used to conserve power when content is changing less rapidly.

Figure 7:
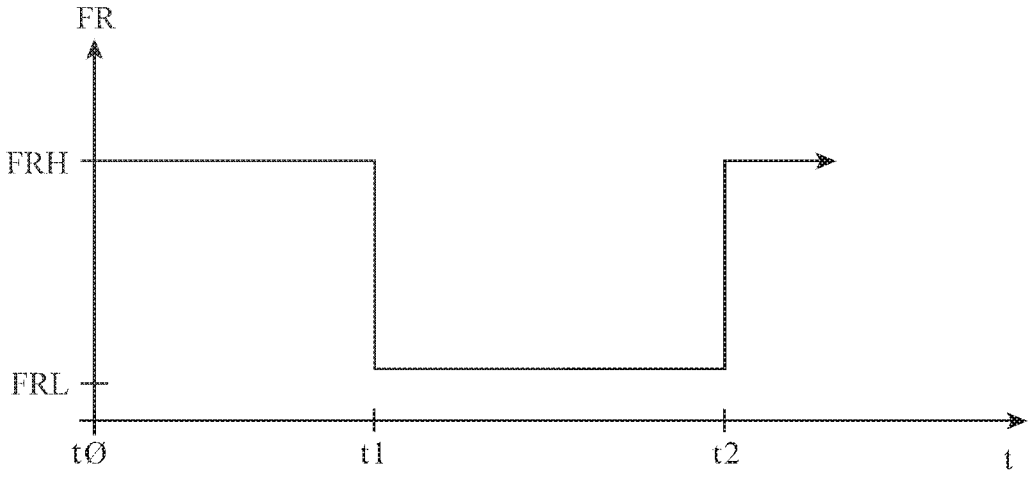
FIG. 7 is a graph showing how the refresh rate of a display may be varied as a function of time in accordance with an embodiment.

A graph in which frame rate FR has been plotted as a function of time in an illustrative configuration in which display 14 has variable refresh rate capabilities is shown in FIG. 7. As shown in FIG. 7, display 14 may be operated at an elevated frame rate FRH when it is desired to display rapidly moving content on display 14 (e.g., video). Frame rate FRH may be, for example, 60 Hz, 30 Hz, or other relatively high frame rate. In the example of FIG. 7, display 14 uses frame rate FRH at times between t0 and t1. At time t1, elevated frame rate FRH is no longer needed, so device 10 lowers frame rate FR for display 14 to lowered frame rate FRL (e.g., for times between t1 and t2, before frame rate FR is returned to high frame rate FRH). Frame rate FRL may be, for example, a rate between 1 Hz and 10 Hz, less than 10 Hz, or other frame rate lower than frame rate FRH. Because the frame rate has been reduced, power consumption at times between times t1 and t2 may be reduced within display 14.

The reduced frame rates that are involved in operating a display with variable refresh rate capabilities are associated with frames of potentially long duration (e.g., 1 s, etc.). Particularly in scenarios in which display 14 is operating with long frames, there is a potential for an undesirable interplay between the pattern of content being displayed on display 14 and the polarities of the frames that can lead to excessive charge accumulation.

To ensure that device 10 and display 14 operate satisfactorily, a charge accumulation tracker may be implemented that monitors for the occurrence of conditions that are likely associated with excess charge accumulation. When charge accumulation is detected, remedial actions may be taken. For example, in a display with variable refresh rate capabilities, variable refresh operations can be suspended (e.g., by returning device 10 to high refresh rate FRH for a given period of time or by at least elevating the frame rate for display 14 above desired low rate FRL for a given period of time). As another example, the polarity of the frames of image data being displayed on display 14 can be flipped (e.g., by inserting an extra positive frame between a positive frame and a negative frame).

The charge accumulation tracker can be spatially sensitive. For example, display 14 may be divided into multiple subregions (e.g., rectangular blocks), each of which may be monitored separately to determine whether excessive charge accumulation is present. The charge accumulation tracker may also take into account the gray level of displayed content, weighting higher gray levels (whiter content) more heavily than lower gray levels (darker content). The duration of positive and negative frames (which affects how long the content is displayed with each polarity) can also be taken into account. Based on these inputs and/or other information, the charge accumulation tracker may determine whether or not remedial actions are required.

If desired, the charge accumulation tracker may determine the average gray level for each frame (i.e., the charge accumulation tracker in this type of arrangement will not divide display 14 into an array of smaller blocks and will therefore not be spatially sensitive). The average gray level in each frame may be, for example, the mean gray level of the pixels in the frame or may be the median gray level of the pixels in the frame. Scenarios in which the charge accumulation tracker uses a fixed estimation of the average gray level of each frame (e.g., by assuming that frames include a worst-case gray level of 255 or include an average gray level of 127 or other suitable fixed value) may also be used by the charge accumulation tracker. Weighting factors may be applied to the computed average gray level to help determine an appropriate charge accumulation metric (which can then be compared against a predetermined threshold to determine whether charge accumulation is excessive and requires remediation). As an example, gray level weighting may be used to weight frames with higher average gray levels more heavily than frames with lower average gray levels and/or time-based weighting may be used to weight positive and negative frames by their respective durations (in addition to taking into account their average gray levels).

Figure 8:
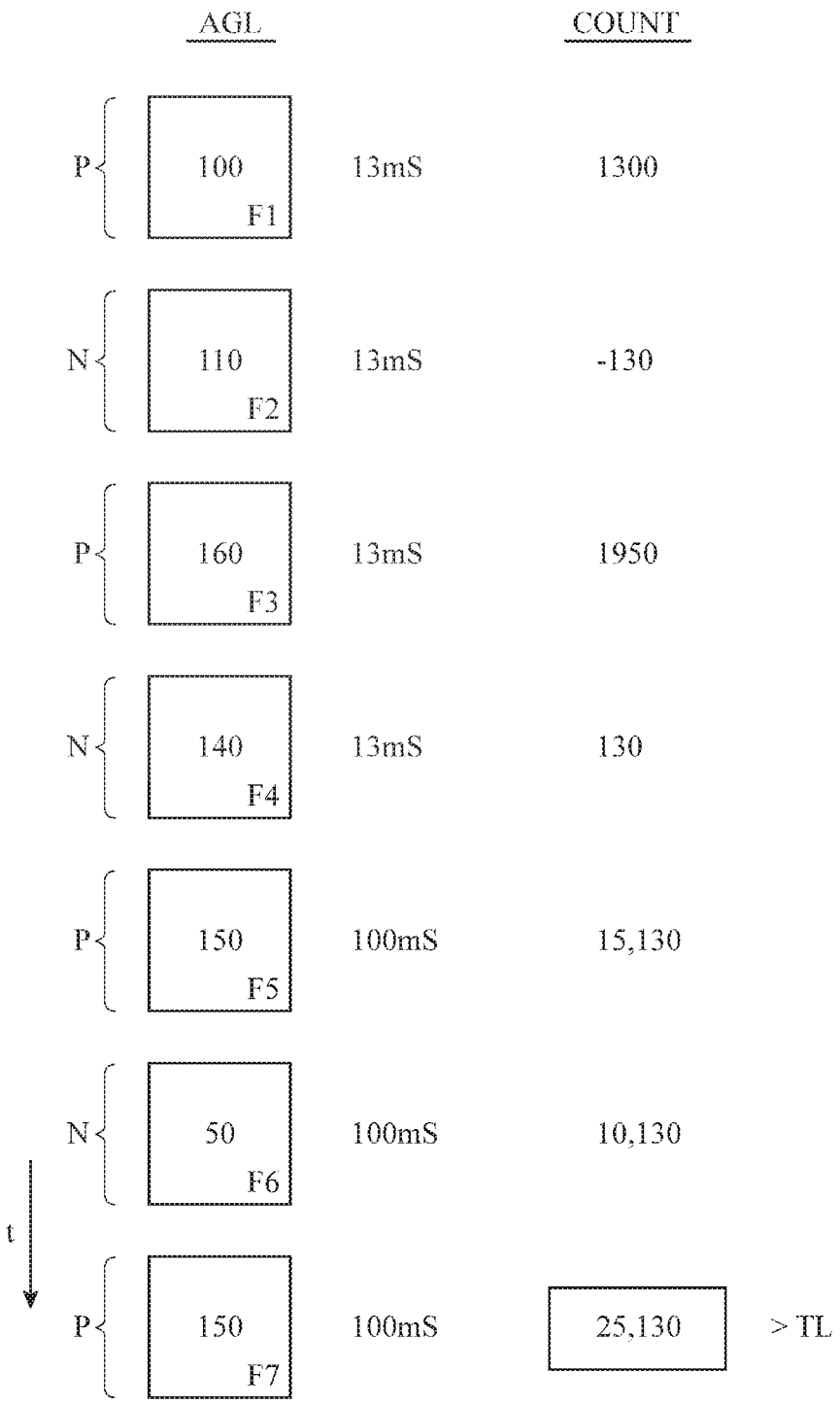
FIG. 8 is a diagram showing how a charge accumulation metric may be computed and compared against a threshold in accordance with an embodiment.

Consider, as an example, the scenario of FIG. 8. In the example of FIG. 8, frames (F1 . . . F7) are being displayed in sequence on display 14 while a charge accumulation tracker is being used to evaluate the gray level of each frame and the duration of each frame (i.e., gray level weighting and frame duration weighting is linear in this example). The charge accumulation tracker computes an updated value for charge accumulation metric COUNT as each frame of image data is displayed on display 14. The value of COUNT is compared to a threshold level (e.g., a threshold level TL of 20,000 in this example). So long as COUNT does not exceed TL, frames of image data may be displayed on display 14 normally (e.g., using a variable refresh rate scheme in combination with alternating positive and negative frame polarities P and N as in the example of FIG. 8). If, however, the charge accumulation tracker determines that the value of COUNT has exceeded threshold value TL, appropriate remedial action may be taken to reduce charge accumulation.

As shown in FIG. 8, the average gray level (AGL) of frame F1 is 100 and the duration of frame F1 is 13 mS. The charge accumulation tracker can compute the product of the average gray level and frame duration to produce an initial count value of COUNT equal to 1300 (13*100). Frame F2 has a negative polarity N (i.e., a polarity that is opposite to that of positive frame F1), so in updating COUNT while displaying frame F2, the charge accumulation tracker may subtract the product of the average gray level of frame F2 (110) and the duration of frame F2 (13 mS) from the value of COUNT following frame F1. The resulting updated COUNT value following frame F2 is −130. Frame F3 has an average gray level of 160, a duration of 13 mS, and a positive polarity P, which brings the value of COUNT up to 1950. Frame F4 has an average gray level of 140, a duration of 13 mS, and a negative polarity. The charge accumulation tracker therefore updates COUNT to have a value of 130 at frame F4.

In the FIG. 8 example, display 14 is a variable refresh rate display. For frame F5 and subsequent frames F6 and F7, the refresh rate (frame rate) for display 14 is reduced to 10 Hz. As a result, each frame has a duration of 100 mS. The lengthened value of each frame is taken into account by the charge accumulation tracker when updating COUNT. As shown in FIG. 8, illustrative frame F5 has an average gray level of 150, a duration of 100 mS, and a positive polarity, so COUNT rises to 15,130 at frame F5. The value of 15,130 is less than threshold value 20,000, so excessive charge accumulation is not present at frame F5. Frame F6 of FIG. 8 has an average gray level of 50. Frame F6 has a duration of 100 mS and a negative polarity, so at frame F6 the updated value of COUNT becomes 10,130 (which is also below threshold TL). Frame F7 of FIG. 8 has an average gray level of 150, a duration of 100 mS, and a positive polarity. When the charge accumulation tracker computes COUNT at frame F7, the updated value of COUNT is 25,130, which exceeds threshold TL. Because threshold TL is exceeded, the charge accumulation tracker recognizes that there is a potential for excess charge accumulation within display 14 and takes appropriate remedial action. As this example demonstrates, the charge accumulation tracker can determine whether excessive charge accumulation has occurred by taking into account factors such as average (mean or median) gray level for each frame, frame duration, and frame polarity and computing the value of a corresponding charge accumulation metric such as parameter COUNT, which can be compared to a predetermined threshold TL. If desired, look-up tables, mathematical functions, or other arrangements may be used to apply weights to the inputs of the charge accumulation tracker. Weighting functions may be linear or non-linear.

Figure 9:
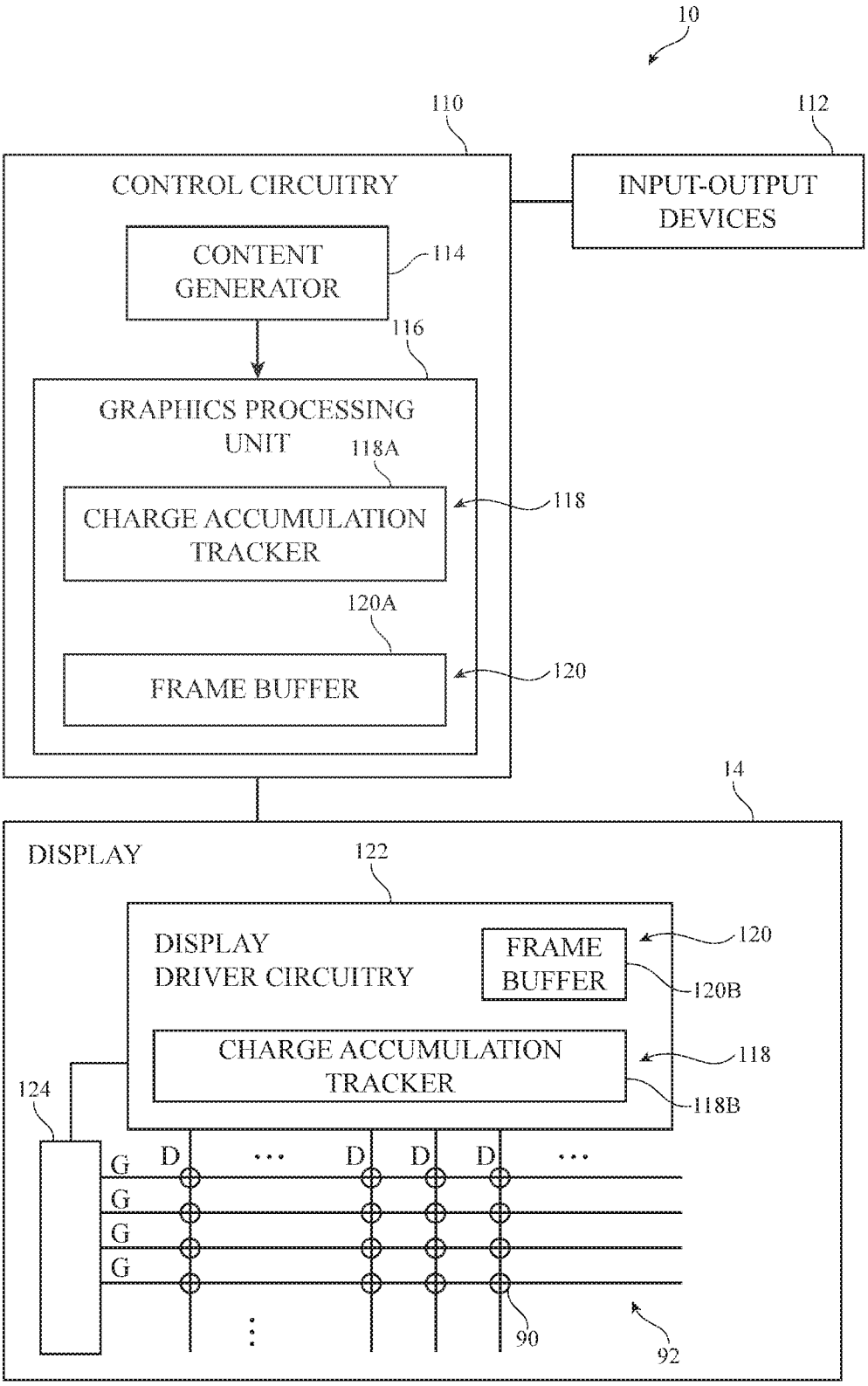
FIG. 9 is a diagram of illustrative circuitry that may be used in operating a display with charge accumulation monitoring capabilities in accordance with an embodiment.

FIG. 9 is a schematic diagram of illustrative circuitry in device 10 that may be used in implementing display 14 and a charge accumulation tracker for monitoring charge accumulation conditions for display 14. As shown in FIG. 9, device 10 may have control circuitry 110. Control circuitry 110 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 110 may be used to control the operation of device 10. The processing circuitry may be based on one or more microprocessors, microcontrollers, digital signal processors, baseband processors, power management units, audio chips, application specific integrated circuits, etc.

Control circuitry 110 may include a graphics processing unit such as graphics processing unit 116. Graphics processing unit 116 may receive image frames for frame buffer 120 (e.g., frame buffer 120A) from content generator 114. Content generator 114 may be an application running on control circuitry 110 such as a game, a media playback application, an application that presents text to a user, an operating system function, or other code running on control circuitry 110 that generates image data to be displayed on display 14.

Control circuitry 110 may be coupled to input-output circuitry such as input-output devices 112. Input-output devices 112 may be used to allow data to be supplied to device 10 and to allow data to be provided from device 10 to external devices. Input-output devices 112 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 112 and may receive status information and other output from device 10 using the output resources of input-output devices 112.

Control circuitry 110 may be used to run software on device 10 such as operating system code and applications. During operation of device 10, the software running on control circuitry 110 (e.g., content generator 114) may display images on display 14 using pixels 90 of pixel array 92. Display 14 may include display driver circuitry such as display driver circuitry 122 (see, e.g., circuitry 62A and 62B of FIG. 5) that receives image data from graphics processing unit 116. The display driver circuitry of display 14 may include one or more display driver integrated circuits (e.g., a timing controller integrated circuit or other display driver circuitry such as display driver circuitry 122 of FIG. 9) and gate driver circuitry 124. Gate driver circuitry 124 may be implemented using thin-film transistor circuitry on a display substrate and/or may be implemented using one or more integrated circuits. Array 92 may have display driver circuitry such as circuitry 124 that is located on the left and right edges of array 92, on only the left edge or only the right edge of array 92, or that is located elsewhere in display 14.

Image frames to be displayed on array 92 by the display driver circuitry may be stored in frame buffer 120 (e.g., frame buffer 120B). Charge accumulation tracker 118 may be implemented using resources in graphics processing unit 116 (see, e.g., charge accumulation tracker 18A) and/or using resources in display driver circuitry of display 14 (see, e.g., charge accumulation tracker 118B). Charge accumulation tracker 118 may use information on frame durations (e.g., the durations for which image frames in frame buffer circuitry 120 are displayed on array 92) in evaluating the values of charge accumulation metrics for the image frames displayed on the pixels of display 14. In arrangements in which frame duration information is not available in graphics processing unit 116, frame duration information may be provided by display driver circuitry 122 (e.g., charge accumulation tracker 118 may be implemented on circuitry 122 as illustrated by tracker 118B of FIG. 9). Charge accumulation tracker 118 may analyze gray levels in the content being displayed on array 92 by processing image frames in buffer circuitry 120. Image frames may be processed in their entirety (e.g., to compute an average gray level for each frame) or image frames may be broken into multiple subregions (e.g., to compute an average gray level or other image parameter related to charge accumulation for each individual subregion).

When subregions of each image frame are evaluated, charge accumulation scenarios that affect only a portion of display 14 can be detected. If, for example, a small portion of display 14 is white for all positive frames and black for all negative frames, whereas the remainder of the display has a relatively constant low gray level across positive and negative frames, there is a risk that a global gray level evaluation technique of the type described in connection with computation of the global COUNT value of FIG. 7 may not recognize the risk of charge accumulation in the small affected portion of display 14. In contrast, a charge accumulation tracker that evaluates subregions of display 14 (e.g., blocks with edges that are 3-8 mm long, more than 1 mm long, less than 1 cm long, or other suitable size), can recognize local charge accumulation problems and can take appropriate remedial action before display flickering and other visible artifacts are noticed by a viewer.

Figure 10:
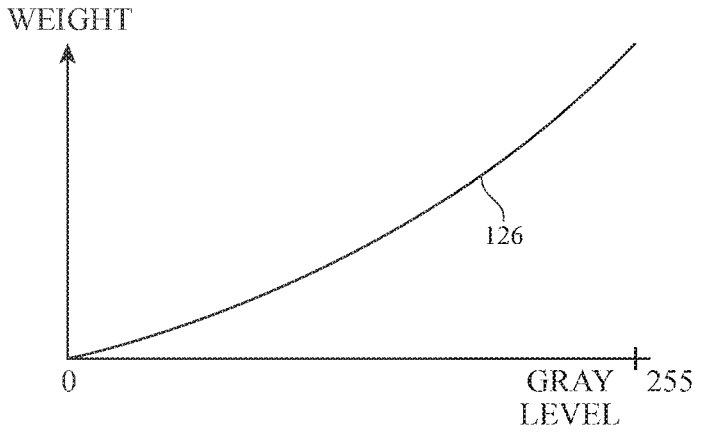
FIG. 10 is a graph showing how a weighting factor for use in computing a charge accumulation metric may vary as a function of gray level in accordance with an embodiment.
Figure 11:
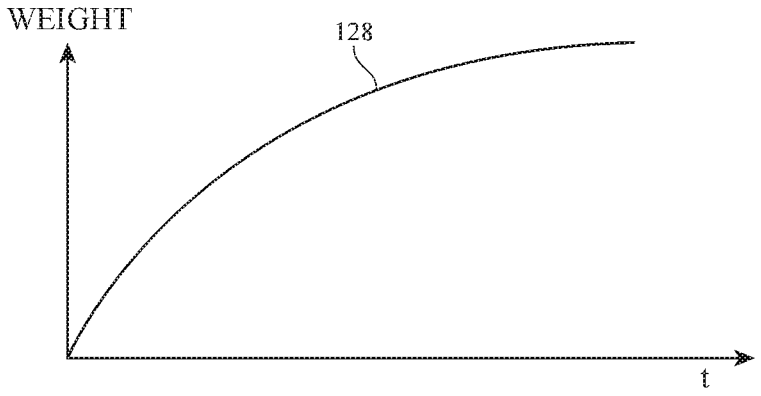
FIG. 11 is a graph showing how a weighting factor for use in computing a charge accumulation may vary as a function of the amount of time for which an image is displayed (image frame duration) in accordance with an embodiment.

When using charge accumulation tracker 118 to evaluate charge accumulation risk in subregions of display 14 (or for entire image frames), the charge accumulation tracker may use look-up tables or mathematical equations to apply weighting functions to inputs such as measured average gray level and image frame duration. Curve 126 of the graph of FIG. 10 represents an illustrative non-linear weighting function that may be applied to measured gray levels in part of an image frame (or an entire image frame). Curve 128 of the graph of FIG. 11 represents an illustrative non-linear weighting function that may be applied to all or part of an image frame based on the duration of that frame (or frame portion). Curves 126 and 128 may be the same for positive and negative polarities or may be different. The weighting functions may be determined by empirical measurements on sample displays (i.e., measurements that evaluate the amount of charge accumulation that is produced at various gray levels and frame polarities for various amounts of time) and/or may be modeled theoretically.

Figure 12:
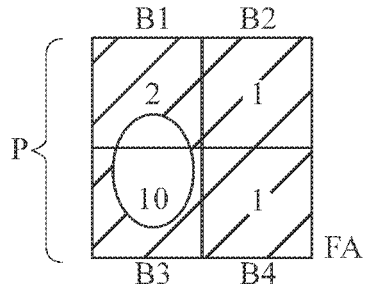
FIG. 12 is a diagram showing how a block-based charge accumulation tracker may monitor charge accumulation for multiple subregions of a display in accordance with an embodiment.
Figure 12:
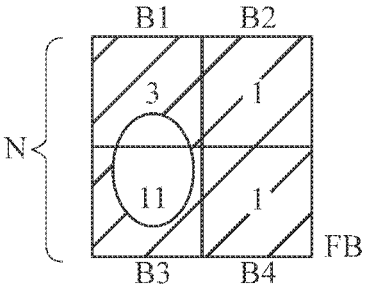
Figure 12:
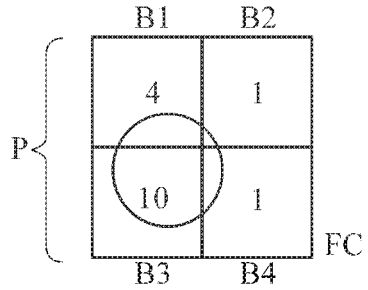
Figure 12:
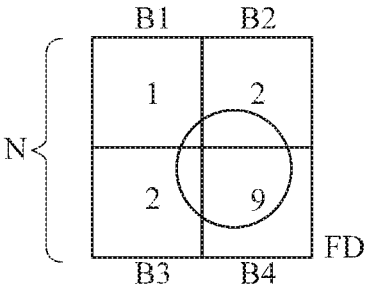
Figure 12:
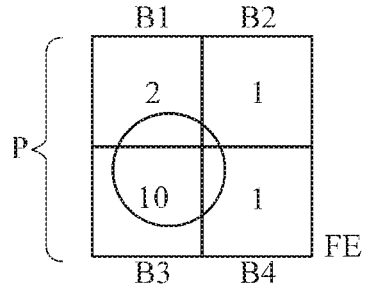

The operation of a display with a configuration in which charge accumulation tracker 118 evaluates image frames on a block-by-block basis (i.e., in which charge accumulation tracker 118 is a block-based charge accumulation tracker) is illustrated in FIG. 12. In the example of FIG. 12, display 14 is displaying image frames FA, FB, FC, FD, and FE. There are four subregions (sometimes referred to as blocks or subareas) of display 14 in the FIG. 12 example. These blocks (blocks B1, B2, B3, and B4) each have varying gray levels. The image frames that containing the blocks have positive polarity P or negative polarity N. All of the frames in the FIG. 12 scenario have the same duration (e.g., 13 mS or other suitable value). As the gray level of the blocks vary from frame to frame, charge accumulation tracker 118 computes charge accumulation metric C1 for block B1, C2 for block B2, C3 for block B3, and C4 for block B4. If the value of any of these metrics (C1, C2, C3, or C4) exceeds predetermined threshold TH (which is 15 in this example), there is an excessive risk for charge accumulation and remedial action can be taken.

Frame FA is a positive frame, so charge accumulation parameters C1, C2, C3, and C4 acquire the values of the gray levels in blocks B1, B2, B3, and B4, respectively. Frame FB is a negative frame, so the value of B1 in frame FB is subtracted from C1 of frame FA, etc. The gray levels of each block in frame FC likewise are added to the respective parameters C1, C2, C3, and C4 and the gray levels of each block in frame FD are subtracted from parameters C1, C2, C3, and C4. As content is being provided to display 14 from content generator 114, there is a potential for the gray levels of blocks B1, B2, B3, and B4 to vary significantly between frames in a pattern that gives rise to charge accumulation in at least one of the blocks. This is illustrated by positive frame FE, in which the value of the charge accumulation metric C3 that has been computed by charge accumulation tracker 118 for block B3 in frame FE exceeds threshold TH. When charge accumulation tracker 118 produces a charge accumulation parameter value for a given one of the blocks that exceeds threshold TH, charge accumulation tracker 118 can conclude that there is a risk of excessive charge accumulation for at least that one subregion of display 14 and can take appropriate remedial action.

Figure 13:
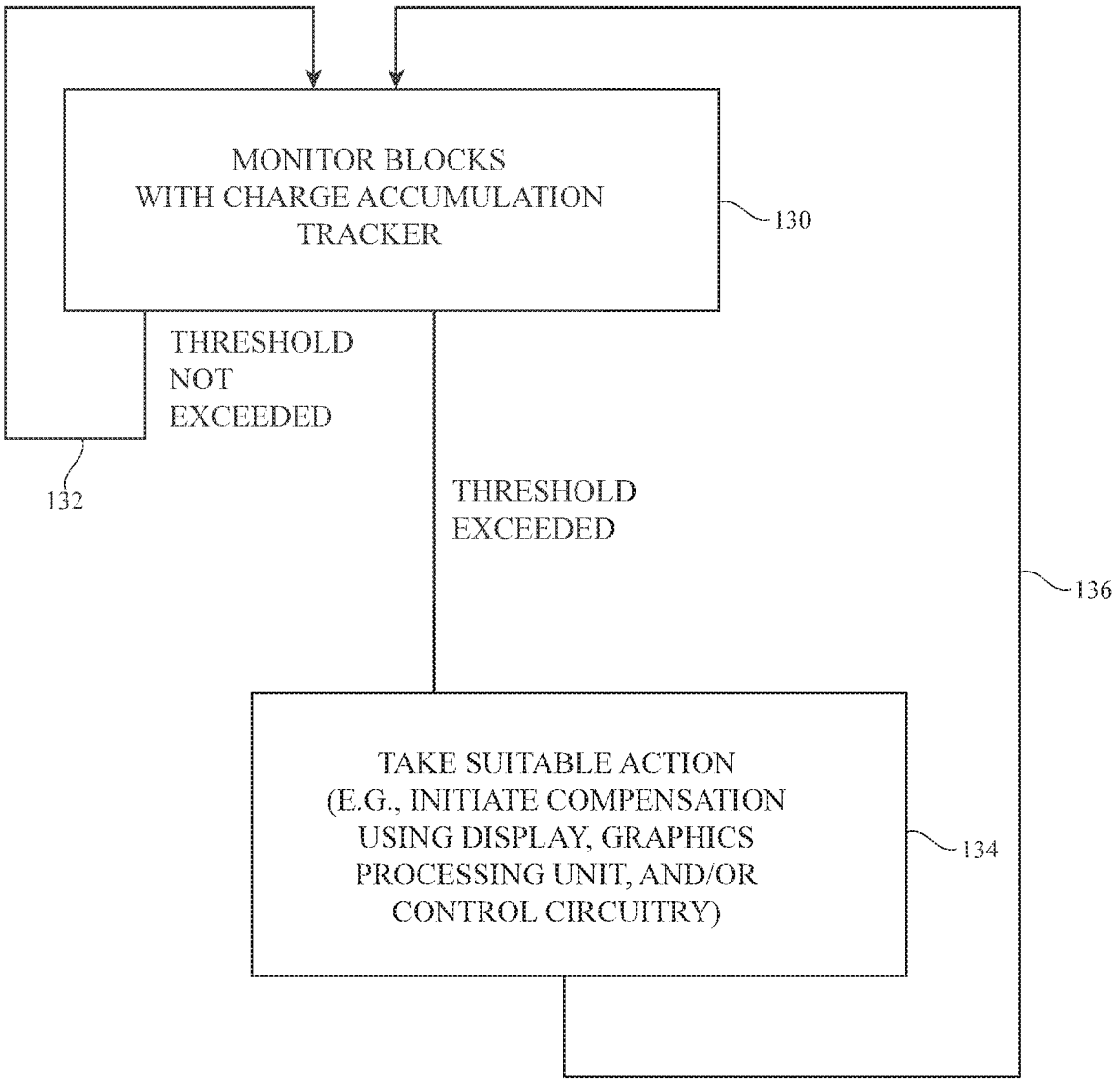
FIG. 13 is a flow chart of illustrative steps involved in operating a display with charge accumulation monitoring capabilities in accordance with an embodiment.

A flow chart of illustrative operations involved in using charge accumulation tracker 118 to monitor for the occurrence of charge accumulation conditions in display 14 is shown in FIG. 13. During the charge accumulation operations of FIG. 13, charge accumulation tracker 118 may monitor image frames globally (e.g., by computing an average gray value for each frame in its entirety) or may monitor charge accumulation in each of multiple subregions such as blocks B1, B2, B3, and B4 of FIG. 12. Configurations in which charge accumulation is evaluated on a block-by-block basis are sometimes described as an example.

At step 130, as content generator 114 provides charge accumulation tracker 118 with image data to display on array 92 of display 14 (e.g., as image frames are provided to the frame buffer circuitry), charge accumulation tracker 118 computes the value of a charge accumulation metric (e.g., C1 . . . C4, etc.) for each subregion of interest in display 14. There may be any suitable number of regions of display 14 that are evaluated by tracker 118 (e.g., one region, two regions, four or more regions, 10 or more regions, 10-100 regions, 100-10000 regions, fewer than 1000 regions, fewer than 100 regions, or other suitable number of subregions). In computing the charge accumulation metric values, tracker 118 may use data stored in look-up tables or other stored data such as weighting data (based on gray level, duration, polarity, etc.) and/or may use mathematical weighting functions to weight raw image data. The computed charge accumulation metric value in each subregion may be compared to a suitable threshold value to determine whether there is a risk of excessive charge accumulation in that subregion.

So long as the computed charge accumulation values do not exceed the charge accumulation threshold, no remedial actions need be taken and processing may loop back to step 130 so that charge accumulation tracker 118 can continue to evaluate the frames of image data being displayed on display 14.

If the charge accumulation threshold is exceeded by the charge accumulation metric that has been computed for any of the subregions of display 14, tracker 118 can initiate appropriate remedial actions (step 134). Processing may then loop back to step 130, as indicated by line 136.

The remedial actions that are performed at step 134 may be performed using graphics processing unit 116 and/or display driver circuitry such as display driver circuitry 122. These actions may include, for example, temporarily suspending variable refresh rate operations (e.g., by restoring the frame rate of display 14 to a relatively high rate such as 30 Hz or 60 Hz or other non-reduced refresh rate rather than allowing a reduced rate of 1-10 Hz to be used), flipping the polarity of the image frames being displayed (e.g., by changing from a scheme in which odd frames are positive and even frames are negative to a scheme in which odd frames are negative and even frames are positive), lengthening the duration of a particular frame (e.g., a positive frame when more positive polarity operations are needed to reduce charge accumulation, etc.), by inserting a remedial frame with a duration and polarity that reduces charge accumulation, or other suitable actions.

The foregoing is merely illustrative and various modifications can be made by those skilled in the art without departing from the scope and spirit of the described embodiments. The foregoing embodiments may be implemented individually or in any combination.

What is claimed is:

1. A display having pixels that display image frames, the display comprising:

a charge accumulation tracker, wherein the charge accumulation tracker receives inputs for each of the image frames, wherein the charge accumulation tracker computes a charge accumulation metric for each of the image frames as the image frames are displayed, wherein the charge accumulation metric is calculated using information from a given one of the image frames and a plurality of image frames that have been previously displayed by the pixels, and wherein the charge accumulation tracker takes remedial action when the charge accumulation metric exceeds a predetermined threshold.

2. The display defined in claim 1, wherein the image frames are displayed on the display with positive and negative polarities and wherein the remedial action comprises adjusting frame polarity of the image frames.

3. The display defined in claim 1, wherein the image frames are displayed with a variable refresh rate, and wherein the remedial action comprises adjusting the refresh rate.

4. The display defined in claim 1, wherein the received inputs comprise gray level values, and wherein the charge accumulation tracker computes the charge accumulation metric for each of the image frames based on the gray level values.

5. The display defined in claim 4, wherein the gray level values include an average gray level value for each of the image frames.

6. The display defined in claim 4, wherein each of the image frames includes multiple subregions, and wherein the gray level values comprise an average gray level value for each of the subregions.

7. The display defined in claim 1, wherein the received inputs comprise frame polarity information, and wherein the charge accumulation tracker computes the charge accumulation metric for each of the image frames based on the frame polarity information.

8. The display defined in claim 1, wherein the received inputs comprise frame duration information, wherein the charge accumulation tracker computes the charge accumulation metric for each of the image frames based on the gray level information.

9. A display having pixels that display image frames, the display comprising:

a charge accumulation tracker, wherein the charge accumulation tracker receives inputs for each of the image frames, wherein the charge accumulation tracker computes a charge accumulation metric for each of the image frames by applying a weighting function to at least one of the received inputs, wherein the weighting function is non-linear, wherein the weighting function varies across each of the image frames, and wherein the charge accumulation tracker takes remedial action when the charge accumulation metric exceeds a predetermined threshold.

10. The display defined in claim 9, wherein the received inputs comprise gray level values.

11. The display defined in claim 10, wherein applying the weighting function comprises applying the weighting function to the gray level values.

12. The display defined in claim 10, wherein the gray level values are average gray level values for each of the image frames.

13. The display defined in claim 10, wherein each of the image frames comprises multiple subregions, and wherein the gray level values are average gray level values for each of the subregions.

14. The display defined in claim 9, wherein the received inputs comprise frame duration information and wherein applying the weighting function comprises applying the weighting function to the frame duration information.

15. An electronic device, comprising:

a display having pixels;

control circuitry that generates image frames that are displayed on the display, wherein each image frame includes multiple subregions, and wherein each of the subregions includes at least one pixel; and a charge accumulation tracker that computes a charge accumulation metric for each of the subregions across the entirety of each image frame, wherein the charge accumulation tracker takes remedial action when the charge accumulation metric for any one of the subregions exceeds a predetermined threshold.

16. The electronic device defined in claim 15, wherein the image frames are displayed on the display with positive and negative polarities and wherein the remedial action comprises adjusting frame polarity of the image frames.

17. The electronic device defined in claim 15, wherein the image frames are displayed with a variable refresh rate, and wherein the remedial action comprises adjusting the refresh rate.

18. The electronic device defined in claim 15, wherein the charge accumulation tracker computes an average gray level for each of the subregions.

19. The electronic device defined in claim 18, wherein the charge accumulation tracker computes the charge accumulation metric for each of the subregions by applying a weighting function to the average gray level for each of the subregions.

* * * * *